US008839495B2

(12) United States Patent
Tuma

(10) Patent No.: US 8,839,495 B2
(45) Date of Patent: Sep. 23, 2014

(54) CLOSURE COMPONENT

(75) Inventor: Jan Tuma, Mönchberg (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 180 days.

(21) Appl. No.: 13/138,168

(22) PCT Filed: Nov. 19, 2009

(86) PCT No.: PCT/EP2009/008233
§ 371 (c)(1),
(2), (4) Date: Jul. 15, 2011

(87) PCT Pub. No.: WO2010/085994
PCT Pub. Date: Aug. 5, 2010

(65) Prior Publication Data

US 2011/0271496 A1 Nov. 10, 2011

(30) Foreign Application Priority Data

Jan. 28, 2009 (DE) ..... 10 2009 006 358

(51) Int. Cl.
*A44B 18/00* (2006.01)

(52) U.S. Cl.
CPC ..... *A44B 18/0065* (2013.01)
USPC ..... 24/452; 24/442

(58) Field of Classification Search
USPC ..... 24/452, 442, 451
See application file for complete search history.

(56) References Cited

U.S. PATENT DOCUMENTS

| | | | | |
|---|---|---|---|---|
| 4,322,875 | A | 4/1982 | Brown et al. | |
| 5,097,570 | A * | 3/1992 | Gershenson | 24/452 |
| 5,250,253 | A * | 10/1993 | Battrell | 264/557 |
| 6,904,649 | B2 * | 6/2005 | VanBenschoten et al. | 24/452 |
| 7,445,741 | B2 * | 11/2008 | Poulakis et al. | 264/254 |
| 7,811,272 | B2 * | 10/2010 | Lindsay et al. | 604/389 |
| 8,007,892 | B2 * | 8/2011 | Tuma | 428/99 |
| 8,375,529 | B1 * | 2/2013 | Duffy | 24/452 |
| 2003/0045856 | A1 * | 3/2003 | Couture et al. | 604/391 |
| 2003/0120251 | A1 * | 6/2003 | Couture et al. | 604/391 |
| 2003/0190451 | A1 | 10/2003 | Baker et al. | |
| 2004/0134045 | A1 * | 7/2004 | Poulakis et al. | 24/442 |
| 2006/0005362 | A1 * | 1/2006 | Arzt et al. | 24/442 |
| 2011/0265292 | A1 * | 11/2011 | Kirby et al. | 24/451 |

FOREIGN PATENT DOCUMENTS

| | | |
|---|---|---|
| DE | 10 2004 012 067 | 10/2005 |
| DE | 10 2006 024 014 | 11/2007 |
| WO | WO 03/059108 | 7/2003 |
| WO | WO 2007/134685 | 11/2007 |
| WO | WO 2008/076391 | 6/2008 |

* cited by examiner

*Primary Examiner* — Robert J Sandy
*Assistant Examiner* — Rowland Do
(74) *Attorney, Agent, or Firm* — Roylance, Abrams, Berdo and Goodman LLP

(57) ABSTRACT

A closure component has a plurality of closure components (12) with each disposed on a carrier part (10) by a footer (18). Each has a header (14) connected to the footer (18) by a shaft part (16). The header (14) is jointedly connected to the shaft part (16) by a hinge part (20). Because the footer (18) forms a further hinge part (22), by which the shaft part (16) is jointedly connected to the carrier part (10), improved adhesion to third components can be produced.

14 Claims, 1 Drawing Sheet

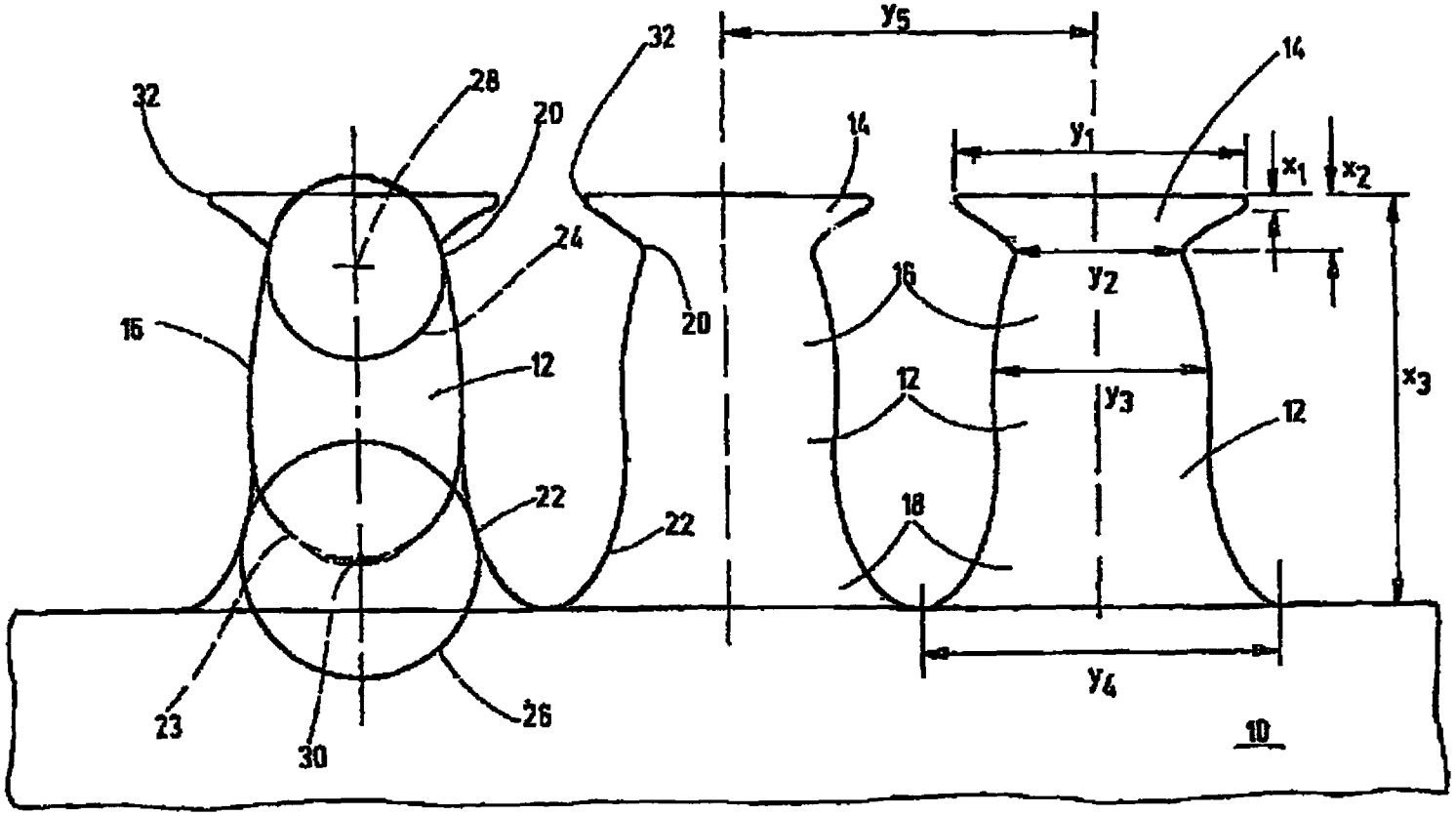
x3
x2
x1
14
12
10
y1
y2
y3
y4
y5
16
12
18
14
20
22
32
20
24
12
22
26
28
30
32
16
23

CLOSURE COMPONENT

FIELD OF THE INVENTION

The invention relates to a closure component with a plurality of closure components which are spaced apart from one another and which are each located by a base part on a backing part. Each component has a head part connected via a stem part to the base part. The head part is articulated to the stem part via an articulated part.

BACKGROUND OF THE INVENTION

WO 2004/105536 A1 discloses a touch-and-close fastener part in which the free ends of the stem parts of the individual adhesion elements are provided with a plurality of individual fibers. The diameter of the respective fibers has to be chosen to be very thin so that on the free end of each individual fiber only a very small contact surface is available, of the magnitude of 0.2 to 0.5 μm.

These orders of magnitude, which can also be in the nanometer range in preferred configurations, enable interaction with a corresponding body in the vicinity on which the touch-and-close fastener part is to be fixed by van der Waals forces which are classically considered as a subgroup of adhesion. The known touch-and-close fastener part has good connecting properties, but is tied to a correspondingly cost-intensive production process.

This situation also applies to a touch-and-close fastener part according to the teaching of publication WO 01/49776 A2, which instructs one skilled in the art to use parts of the base structure of a gecko directly as biological material or to artificially simulate it. This adhesive structure has a plurality of spatula components which are each divided in the form of a bent cylindrical closure element on the free end into a plurality of individual filaments.

Conversely, for simplified production, DE 102 23 234 B4 proposed a method for surface modification of an object in the form of a closure component with the objective of increasing the adhesion capacity of the adhesion element. For this purpose, the free surface is exposed to structuring in order to form a plurality of projections which are each provided with a base part and a head part. The head part has an end surface pointing away from the surface. Each projection is formed with a size such that all end surfaces have the same vertical height over the surface. This structure yields an adherent contact surface which is interrupted by respective distances between the end surfaces. The base parts of the projections are tilted relative to the surface normal of the surface.

With this known solution, it is possible to make available the execution of detachable adhesive connections for an expanded range of materials with increased adhesion capacity and the possibility of enabling the setting of predetermined adhesive forces or properties. However, based on the relatively rigid arrangement between the head part and backing part over the stem parts which may be tilted, there is room for improved solutions.

WO 2007/134685 A1 discloses a generic touch-and-close fastener part. The head part of each closure component has a head disc whose diameter is chosen to be larger than the diameter at any point of the stem part which, made conical in shape, is articulated via an articulated part to the head disc. This structure results in that the head part certainly remains adhering to a body in the vicinity, even if the backing part should move axially in the plane-parallel direction to this body by a definable amount. As a result of the linking via the respective articulated part, located between the stem part and head part, the respective stem part can tilt within a definable framework in the oblique direction without this adversely affecting the linking of the head part relative to the body in the vicinity. Since the head part with the head disc can have a very large diameter in the known solution, the possibility of adhesion to the ambient body is improved accordingly.

Especially when vibrations occur during which the backing part executes short-stroke vibrations relative the body in the vicinity, the known touch-and-close fastener part has been found to be an effective connection solution.

SUMMARY OF THE INVENTION

An object of the invention is to provide an improved adhesive closure component, in particular to supply improved adhesion and closure action for the respective touch-and-close fastener part with the simultaneous option of being able to produce these systems economically and with functional reliability.

This object is basically achieved by a touch-and-close fastener part where the base part forms another articulated part by which the stem part is articulated relative to the backing part. Compared to known solutions, improved adhesion relative to third components can be produced. Due to the second articulated part in the region of the base part, relative to the backing part a damping element is formed which relieves the first articulated part in the region of the head part. This structure enables higher vibration and impact forces to be fed into the touch-and-close fastener part without it unintentionally detaching from the third component. Detachment of the head part in the manner of a peeling motion from the body in the vicinity as a third component only takes place when the head part is tilted via the respective articulated part by an angle of at least 20°, preferably of at least 40° relative to the vertical. Standing thereon in the vertical direction, the backing part is oriented with its alignment.

The good adhesive action formed in this way also fundamentally applies when a conventional option of hooking underneath is implemented for the closure component, for example, by a loop part of a corresponding touch-and-close fastener part engaging the closure component designed as a mushroom or hook part by hooking underneath. In these cases as well, it has been shown that as a result of the double articulation arrangement an improved closure action is achieved which, if necessary, can also be detached again mechanically or by hand in order in this way to form an adhesive closure which can be repeatedly opened and closed.

In one especially preferred embodiment of the touch-and-close fastener part according to the invention, the respective stem part is made reinforced, in particular, is provided in cross section with a widening. This widening has at least in part the shape of a regular or irregular ellipsoid or is structured in the form of an elliptical paraboloid. As a result of the widened stem part, which extends between the two articulated parts on the head and base part, vibration stiffening of the entire system is achieved with increased support function for the indicated opposing articulation sites or articulated parts.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure:

FIG. 1 is a schematic, not to scale, a side elevational view of a touch-and-close fastener part according to an exemplary embodiment of the invention, with a total of three closure components located on a backing part.

DETAILED DESCRIPTION OF THE INVENTION

The orders of magnitude addressed with the touch-and-close fastener part in the geometrical implementation should suffice and are designed such that an interaction with a corresponding part, whether in the form of another touch-and-close fastener part or in the form of the surface of a body in the vicinity on which the touch-and-close fastener part according to the invention is to be fixed, can preferably take place by van der Waals forces. The van der Waals forces which constitute a subgroup of adhesion are formed because the negatively charged electrons swirling around the positive core in an atom are briefly concentrated on one side. In this way, the atom on this side is temporarily negatively charged, while it is positively charged on the other side. This charging also affects adjacent atoms. In this case, the atoms along the top of the bearing surface of the head part, with the result that the bearing surface of the head part, depending on which charge it acquires, is attracted either by the positive or the negative atoms of the respective opposite ambient body surface.

The larger the arising contact surfaces are in total, the stronger the forces which occur so that it may prove to be effective to form head part bearing surfaces which are dimensioned to be large in order to obtain strong van der Waals forces. Although the van der Waals forces are considered to be among the weakest forces in nature, the effect is sufficient to achieve relatively high closure forces, in particular, with several thousand closure elements on the extremely small space of the backing part. If the surface of the respective head part should be chemically modified for this purpose, genuine chemical bonding is also possible as the adhesion connection.

The touch-and-close fastener part shown in FIG. 1, for purposes of this invention, can be obtained according to a micro-replication method, as described in DE 196 46 318 A1. The known method is used to produce a touch-and-close fastener part with a plurality of closure components or elements 12 made in one piece with a backing part 10. The closure elements 12 comprise stem parts 16 which have head parts 14 and which are connected in turn via base parts 18 to the backing part 10. Preferably, a thermoplastic in the plastic or liquid state is introduced into a gap between a pressure roll and a molding roll. The molding roll is provided with a screen, with cavities which are open to the inside and outside. The two rolls are driven in the opposite direction of rotation for the production process so that the backing material is formed in the gap between the rolls with the formation of the backing part 10. Since for the touch-and-close fastener part according to the invention the stem parts 14 can be made crowned, the screen cross section is matched to the outer contour of the respective stem part 16. In particular, the stem part 16 is designed as a regular or irregular ellipsoid of revolution. The desired shaping, as shown in FIG. 1, would also be attainable by two paraboloids of revolution, which are facing one another with their free opening cross section. In this way, the indicated screen cross section therefore is to be matched to the shaping of the respective closure component 12.

Another possibility for obtaining the closure component system of FIG. 1 is shown in DE 100 65 819 C1. In this known method for producing the touch-and-close fastener parts, a backing material is provided in at least one partial region of its surface with touch-and-close fastener parts or adhesion elements which project out of the plane by a plastic material which forms the elements being applied to the backing element as backing part 10. The elements are made at least in one partial region without molding tools by the plastic material being deposited in successively released droplets by at least one application device. Although the application device delivers the plastic material with a droplet volume of only a few picoliters via its nozzle, a process sequence which is sufficiently fast thus can be implemented so that within an extremely short time frame a touch-and-close fastener part, as shown in FIG. 1, can be obtained. With this method, individual adhesion elements in particular can also be produced which, in addition to the head part 14 and the stem part 16 as well as the base part 18, form two articulated parts 20, 22 which, viewed in the direction of FIG. 1, are shown at the extreme left as imaginary inscribed circles 24, 26 for better understanding and by way of explanation.

The stem part 16 in turn can be described in terms of its outside contour as part of a regular or, as shown in FIG. 1, irregular ellipsoid of revolution 23. The centers 28 and 30 of the circles 24 and 26 respectively, are located within the ellipsoid of revolution 23 or more or less on its imaginary edge boundary as shown for the center 30 of the circle 26. Instead of the illustrated ellipsoid of revolution 23, the outside contour of the stem part 16 can also be implemented via two paraboloids of revolution which extend in opposite directions (not shown), whose free opening cross sections adjacently border one another. Overall, as a result of the crowned or convex configuration of the stem part 16, a closure component structure, which is stiffened between the articulated parts 20, 22 and which extends between the two articulated parts 20, 22 of each closure component 12, is formed. As especially the increased radius of the circle 26 is intended to show, the articulated part 22 is made thicker in the region of the base part 18 than the overlying articulated part 20 in the direction of the head part 14. In the direction of the base part, the damping action is then improved. In this respect, the stem part 16 at the articulated part 22 undergoes a smaller pivoting motion than in the region of the head part 14 with the upper articulated part 20. As the side view of FIG. 1 shows, for the stem part 16, this configuration yields a convexly extending outside contour which extends between concavely running outside contour portions of the head part 14 and base part 18. Furthermore, the head part 14, proceeding from its articulation site 20 which can be assigned to it, tapers to the outside toward its peripheral edge 32 and there forms a narrow-lipped edge.

The respective closure component 12 is made preferably of a plastic material which is selected in particular from the group of acrylates such as polymethacrylates, polyethylenes, polypropylenes, polyoxymethylenes, polyvinylidene fluoride, polymethylpentene, poly(ethylene) chlorotrifluoroethylene, polyvinyl chloride, polyethylene oxide, polyethylene terephthalate, polybutylene terephthalate, nylon 6, nylon 6.6, and polybutene.

Fundamentally, plastics with long molecular chains and good orientation behavior as well as plastic materials with thixotropic behavior are highly suitable. Thixotropic behavior for purposes of the invention is intended to denote the reduction of structural strength during the shear loading phase and its more or less rapid but complete restoration during the subsequent resting phase. This breakdown/restoration cycle is a completely reversible process. Thixotropic behavior can be defined as a time-dependent behavior.

Furthermore, plastic materials have proven favorable in which the viscosity of 7,000 to 15,000 mPa, measured with a rotational viscosimeter, is sufficient. Preferably, that viscosity has a value of approximately 10,000 mPas at a shearing rate of 10 l/sec. For purposes of a self-cleaning surface, it has moreover proven favorable to use plastic material whose contact angle, as a result of its surface energy for wetting with water, has at least a value of greater than 60 degrees. Under certain circumstances, this surface energy can also be further changed by subsequent treatment methods.

With respect to the aforementioned requirements, polyvinyl siloxane has proven an especially interesting representative of suitable plastic materials. This plastic can be used especially for the formation of head parts 14 and their free tops. The entire closure component 12 including the backing part 10 can be composed of this polyvinyl siloxane plastic material.

FIG. 1 shows fastener part approximately 1,000 times enlarged relative to the actual size. There can be 10,000 to 50,000, preferably 30,000, of these closure components 12 standing tightly next to one another per square centimeter on the homogeneous planiform or strip-shaped backing part 10. A uniform arrangement is preferred in which all closure components 12 in the form of adhesion elements have the same distance to one another. Irregular arrangements or pattern shapes (round, star-shaped, ellipsoidal, etc.) can also be made.

The head parts 14 which are disk-shaped in terms of the outside contour can also have other shapes. For example, they can be made elliptical or polygonal in shape, the hexagonal shape having been found to be especially favorable, even with respect to the indicated screen shaping method. For the stem parts 16, are with respect to the release from the shaping screen which is to be undertaken, a crowned structure is favorable.

The individual size ratios in the direction of FIG. 1 are as follows for the closure component 12 at the extreme right:

Y1=30 to 55 μm
Y2=approx. 28 μm
Y3=approx. 35 μm
Y4=40 to 65 μm
Y5=30 to 65 μm
X1=approx. 2 μm
X2=approx. 8 μm
X3=60 to 80 μm While Y5 indicates the distance of two adjacent center axes of closure components 12, the distance is approximately 115 μm standing vertically on the plane of the drawing to the respective next closure component 12 located in the middle between two closure components 12 lying in the plane of the figure, to the closure component 12 which lies comparably behind in the plane of the drawing. These size ratios are only exemplary and yield an especially favorable and well-functioning touch-and-close fastener part. Other size ratios are also conceivable here.

Since the two articulated parts 20, 22 can be adjusted independently of one another, considerably more degrees of freedom than in the known single articulation solution in the region of the head part are possible. This in turn benefits improved linking even with strong stress on third components.

While one embodiment has been chosen to illustrate the invention, it will be understood by those skilled in the art that various changes and modifications can be made therein without departing from the scope of the invention as defined in the appended claims.

What is claimed is:

1. A closure component forming an adhesion touch-and-close fastener part, comprising:

a backing part; and a plurality of closure elements spaced apart from one another on said backing part, each said closure element having a base part connected to said backing part and a head part connected to the respective base part by a stem part, each said head part being articulated to the respective stem part via first articulated part, each said base part forming a second articulated part via which the respective stem part is articulated relative to said backing part, each said stem part extending with a convex outside contour between concave outside contour portions of the respective head part and the respective base part, each said head part having a free end side forming a contact surface enabling a detachable adhesion to a body in a vicinity thereof by an adhesion Van-der-Waals force.

2. The closure component according to claim 1 wherein each said stem part is reinforced by having a cross section with a widening.

3. The closure component according to claim 2 wherein each said widening has at least in part a shape of one of an ellipsoid and an elliptical paraboloid of revolution.

4. The closure component according to claim 1 wherein each said head part is detachable from a connection with a body by a peeling motion in a vicinity thereof by tilting of each said head part by the respective first and second articulated parts at an angle of at least 20 degrees.

5. The closure component according to claim 4 wherein said angle is at least 40 degrees.

6. The closure component according to claim 1 wherein each said head part has an outer periphery not greater than an outer periphery of the respective base part at a transition site to said backing part.

7. The closure component according to claim 1 wherein each said head part tapers from the respective first articulated part outwardly to a narrow-lipped peripheral edge thereof.

8. The closure component according to claim 7 wherein at least parts of each said head part are of polyvinyl siloxane.

9. An adhesive closure component, comprising:

a backing part; and a plurality of closure elements spaced apart from one another on said backing part, each said closure element having a base part connected to said backing part and a head part connected to the respective base part by a convex stem part, each said head part being articulated to the respective stem part via first articulated part, each said base part forming a second articulated part via which the respective stem part is articulated relative to said backing part, each said stem part being reinforced by having a cross section with a widening, each said widening having at least in part a shape of one of an ellipsoid of revolution and an elliptical paraboloid of revolution, each said head part having a free end side forming a contact surface enabling a redetachable adhesion to a body in a vicinity thereof by an adhesion Van-der-Waals force.

10. The adhesive closure component according to claim 9 wherein each said head part is detachable from a connection with a body by a peeling motion in a vicinity thereof by tilting of each said head part by the respective first and second articulated parts at an angle of at least 20 degrees.

11. The adhesive closure component according to claim 10 wherein said angle is at least 40 degrees.

12. The adhesive closure component according to claim 9 wherein each said head part has an outer periphery not greater than an outer periphery of the respective base part at a transition site to said backing part.

13. The adhesive closure component according to claim 9 wherein each said head part tapers from the respective first articulated part outwardly to a narrow-lipped peripheral edge thereof.

14. The adhesive closure component according to claim 13 wherein at least parts of each said head part are of polyvinyl siloxane.

* * * * *